US005112103A

United States Patent [19]

Downer

[11] Patent Number: 5,112,103

[45] Date of Patent: May 12, 1992

[54] PEDESTALED SEAT

[76] Inventor: Stephen H. Downer, 443 Deerwood Dr., Fredericksburg, Va. 22401

[21] Appl. No.: 707,308

[22] Filed: May 29, 1991

Related U.S. Application Data

[63] Continuation-in-part of Ser. No. 519,104, May 4, 1990, abandoned.

[51] Int. Cl.[5] ..... A47C 3/02

[52] U.S. Cl. ..... 297/270; 297/461; 297/192

[58] Field of Search ..... 297/258, 439, 270, 461; 248/910, 348, 188.9, 188.1, 158; 108/150, 151, 194, 93, 96

[56] References Cited

U.S. PATENT DOCUMENTS

| | | | |
|---|---|---|---|
| 927,234 | 7/1909 | Haley | 297/270 |
| 1,323,946 | 12/1919 | Wright | 297/270 |
| 1,788,096 | 1/1931 | Friedemann | 108/96 |
| 1,914,473 | 6/1933 | Wilson | 297/270 |
| 2,038,806 | 4/1936 | Sellor | 297/461 |
| 2,720,249 | 10/1955 | Peterson | 108/150 |
| 3,230,909 | 1/1966 | Watson | 297/439 |
| 3,312,437 | 4/1967 | Barth | 297/439 |
| 3,850,117 | 11/1974 | Martinelli | 108/150 |
| 4,501,201 | 2/1985 | Fitzner et al. | 108/150 |

FOREIGN PATENT DOCUMENTS

| | | | |
|---|---|---|---|
| 2460649 | 3/1981 | France | 297/461 |

*Primary Examiner*—Kenneth J. Dorner
*Assistant Examiner*—Cassandra L. Hope
*Attorney, Agent, or Firm*—Oblon, Spivak, McClelland, Maier & Neustadt

[57] ABSTRACT

A gardening stool that can also be used on hard surfaces. The stool includes a seat, an upright column and a rounded base. The rounded base allows the stool to be rocked. Spheres are provided along the outer periphery of the base which prevent the stool from being rocked on a hard surface, thus providing stability but still allow the stool to be rocked in the soft soil of a garden. A tool holder can be mounted on the column to hold gardening tools. A series of holes may be provided in the column to support the tool holder by means of pins.

12 Claims, 5 Drawing Sheets

PEDESTALED SEAT

This application is a continuation-in-part of application Ser. No. 07/519,104, filed on May 4, 1990, now abandoned.

BACKGROUND OF THE INVENTION

1. Field of the Invention

The present application is for a stool for use in a garden and more particularly to a stool which can be rocked on soft surfaces but which cannot be rocked on a hard surface.

2. Discussion of the Background

Various kinds of stools and chairs are well known with each particular structure designed for its intended use. Many of these stools include three or four legs with a horizontal seat. Many other structures are also known.

U.S. Pat. No. 2,049,539 shows a stool which can be used in a garden. The top of the stool is a horizontal surface which is supported by four legs connected to a base. The base is concave for receiving gardening tools. The outside of the base is rounded to allow rocking by the user so he can reach various parts of the garden. The center part of the bottom is flat to make the stool stable when it is not being rocked. A downturned rim prevents the stool from tilting too far.

U.S. Pat. No. 432,560 shows a stool for a cotton-picker with a seat mounted on a vertical pole and having a small flat foot piece at the end of the pole.

While these devices are useful in gardening situations, there are certain drawbacks for their use. If the stool is moved to a hard surface such as the floor of a house, the stool may not be completely stable. Furthermore, access to tools lying in the base is not completely convenient, especially since the legs interfere with access to the tools.

SUMMARY OF THE INVENTION

Accordingly, one object of the present invention is to provide a novel stool which can be rocked in soil in all directions but which is stable on hard surfaces.

Another object of this invention is to provide a novel stool having convenient storage for tools and easy access thereto.

A further object of this invention is to provide a novel stool for use in a garden which is simple in construction, convenient and comfortable.

These and other objects of the invention are accomplished by providing a stool having an upright pedestal between a saucer-shaped seat and a rounded base shaped like a bowl. The base carries a series of spheres toward its outer edge to stabilize the stool on hard surfaces. A tool holder may be mounted on the pedestal.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
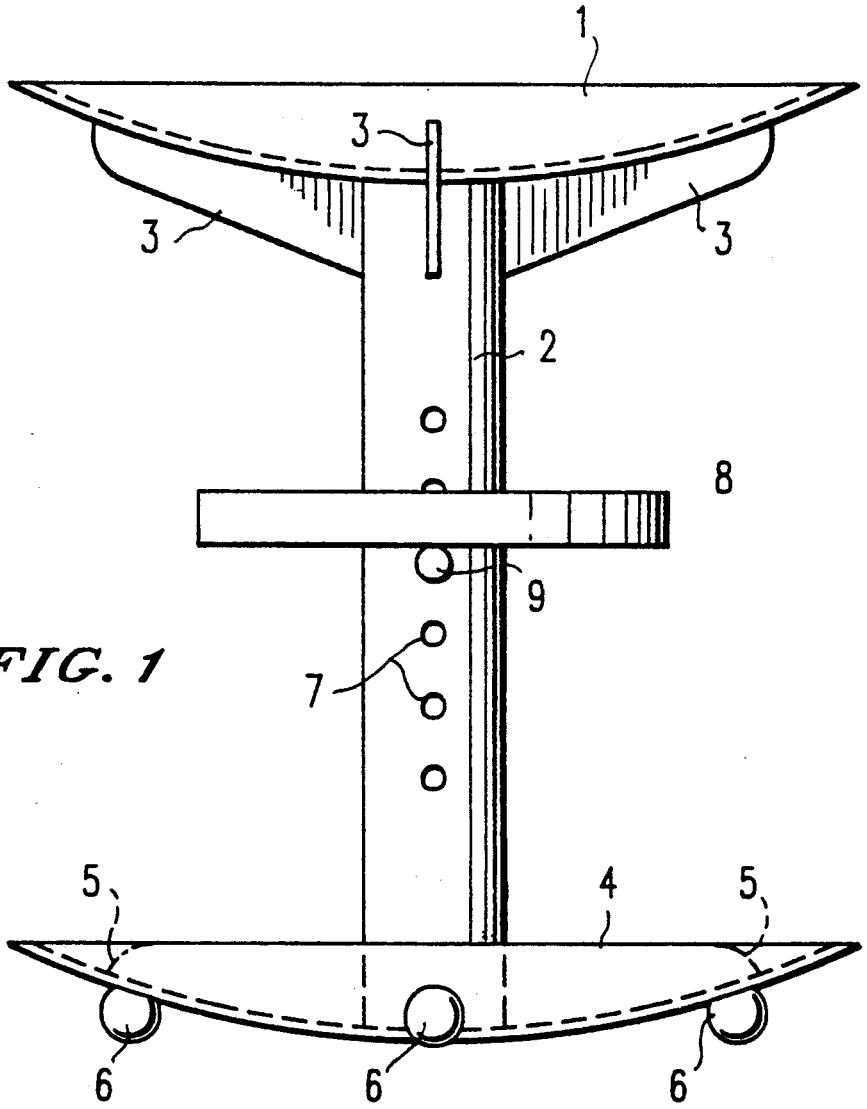
FIG. 1 is a front view of the device of the present invention.
Figure 4:
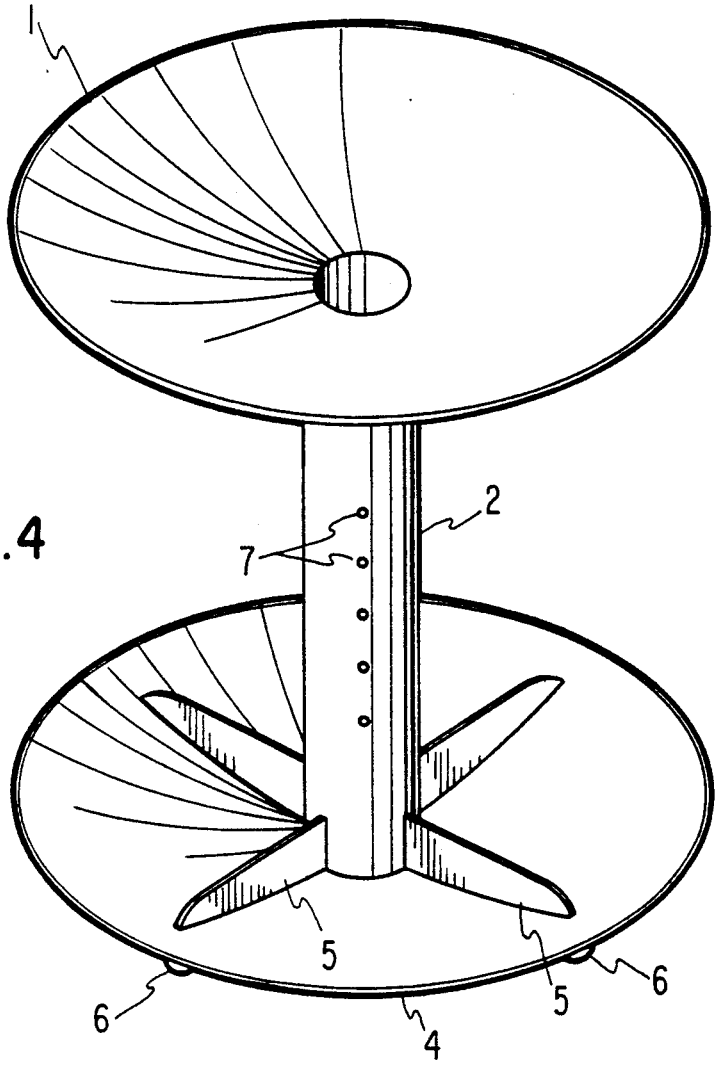
FIG. 4 is a perspective view of the first embodiment of the present invention.

Referring now to the drawings, wherein like reference numerals designate identical or corresponding parts throughout the several views, and more particularly to FIG. 1 thereof, wherein FIG. 1 shows an overall view of the device. The stool includes a saucer-shaped seat 1 which is mounted on a vertical column 2. Appropriate bracing 3 may be used to help support the seat. The bottom of the column rests on a concave base 4, which is bowl shaped as shown in FIG. 4. Additional bracing 5 may also be provided within the base. The bracing for both the seat and base may be vertical, planar pieces having any shape which provides sufficient support. A series of spheres 6, preferably four, are mounted on the bottom of the base toward the outer edges thereof.

Since the base is bowl shaped, it is possible to rock the stool in any direction. The spheres will support the stool in a stable upright position when placed on a hard surface. However, when used in a garden, the spheres merely embed themselves in the soil when the user tilts the stool in that direction. Accordingly it is possible to conveniently place the stool in one position and rock in several different directions in order to reach various plants without moving the stool. The stool may be made from plastic or any other convenient material, such as metal. If made from plastic, it is possible to mold the main parts of the devices in a single unit if desired.

Figure 3:
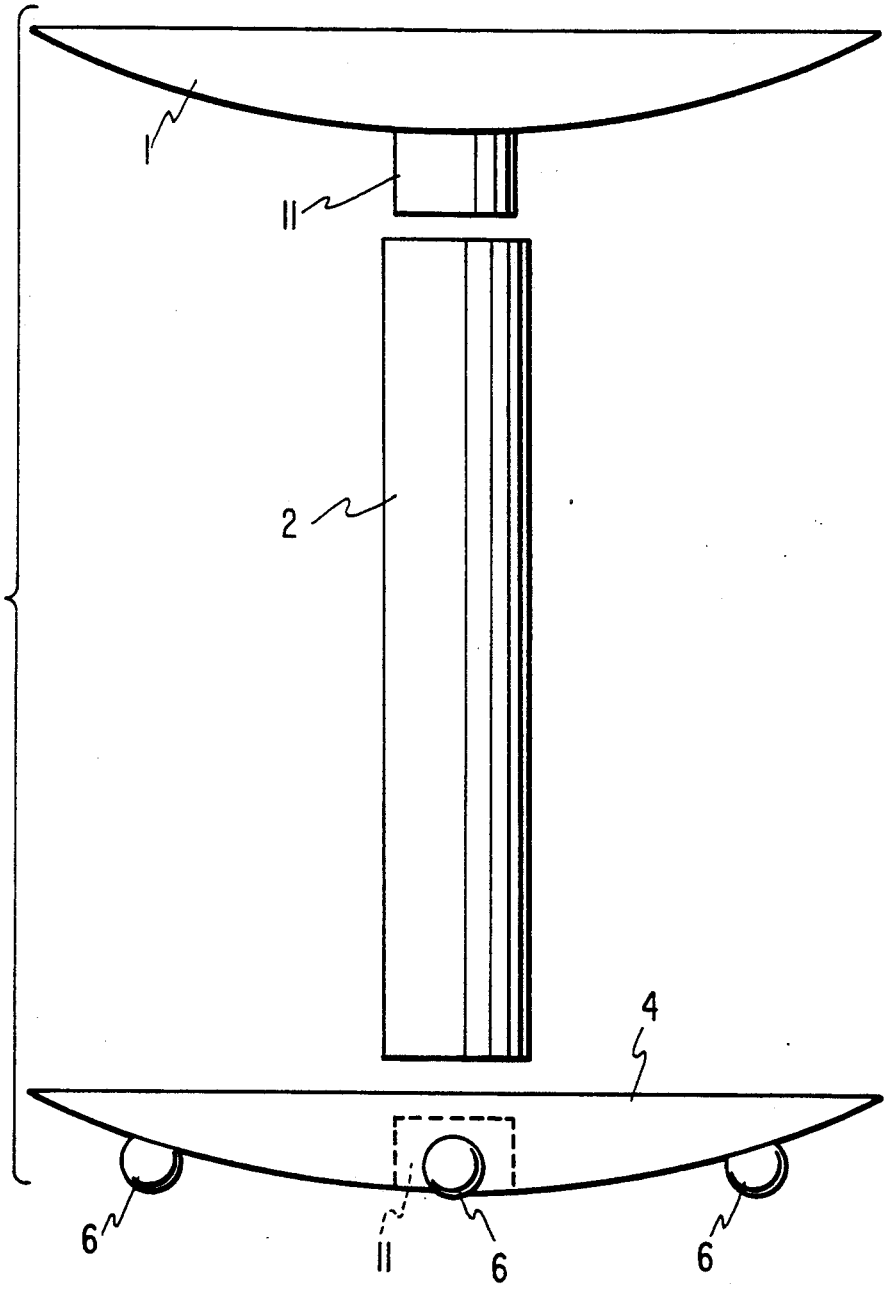
FIG. 3 is a front view of a second embodiment of the present invention.

It is possible to form the base seat and column from plastic material, as seen in FIG. 3. The base and seat may then be made with protrusions 11 having a diameter either slightly larger or slightly smaller than the column so that the protrusions may be received within the column to firmly hold it together. If the protrusions are long enough the three parts will hold together by friction. However if necessary the parts may be glued together or a mechanical fastener may be used.

Figure 6:
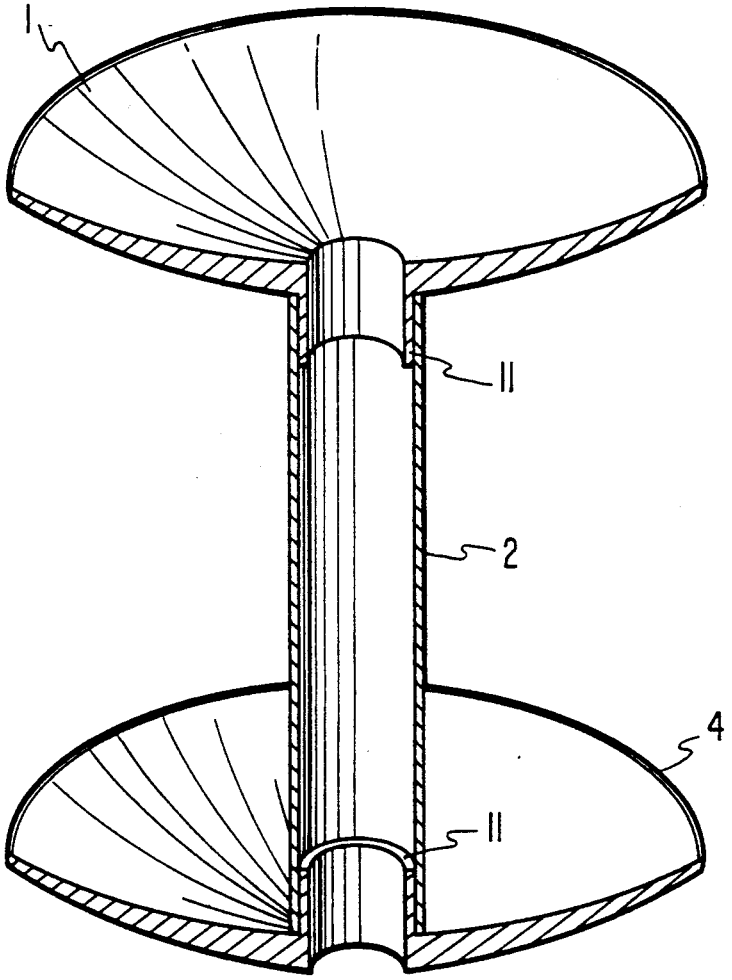
FIG. 6 is a cross-sectional view of the second embodiment of the present invention.

FIG. 6 shows a cut away view of this embodiment with the protrusions 11 for both the seat and base resting within the column 2. Bracing is not utilized in this embodiment since it would interfere with the placement of the protrusions into the column. Thus, the base and seat must be made strong enough to support the weight without such bracing. Although FIG. 6 does not show the spheres, they would be mounted in the same manner shown in the other figures.

The column 2 may be provided with a series of holes 7 for receiving a pin 9. These holes are used to support a tool holder 8 whose position is adjustable along the length of the column.

Figure 2:
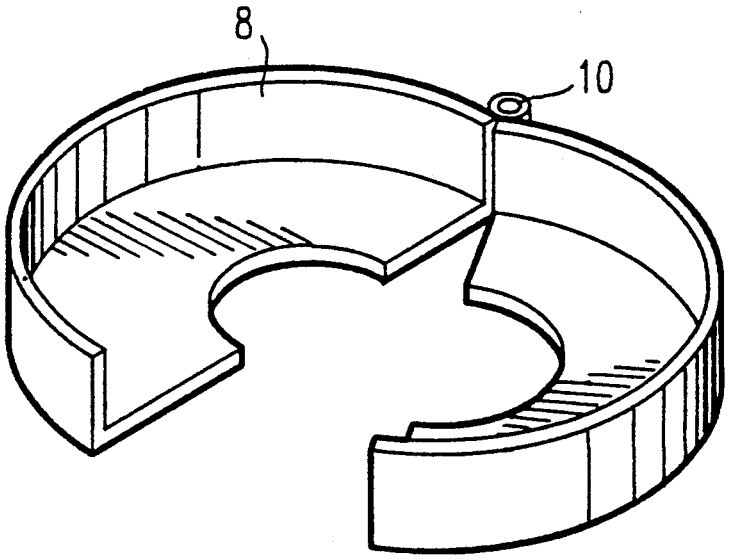
FIG. 2 a top view of the tool holder shown in FIG. 1.

The tool holder may assume a number of different shapes and may be mounted to the column in a number of different manners. FIG. 2 shows one simple shape as being essentially disc-shaped having a hinge to at one end of a diameter for enabling the holder to slip over the column. A fastener may be placed opposite the hinge to hold the two open ends together. This fastener may be a hook and eye, a nut and bolt or any other standard device known in the art. The tool holder may have a vertical wall around its periphery to keep the tools from falling out. A central opening is provided so that the tool holder will fit around the column. The opening size may be such that the tool holder fits snugly around the column. Pin 9 may support the tool holder by itself if the fit is snug enough. It is also possible to have pins on opposite sides or multiple positions to support the tool holder. Although the tool holder is shown as resting on a pin 9, it is also possible for the pin to pierce the vertical wall in the tool holder so that it is suspended rather than supported from underneath. Other shapes of tool holders may be used depending on the types of tools needed. Also, instead of disc-shaped holders, it would be possible to include holders with pockets, holders with deeper walls or any other shape. The holders may extend completely around the column as illustrated in FIG. 2 or may merely be supported on one side of the column. Any form of fastening may also be used which is convenient.

Figure 7:
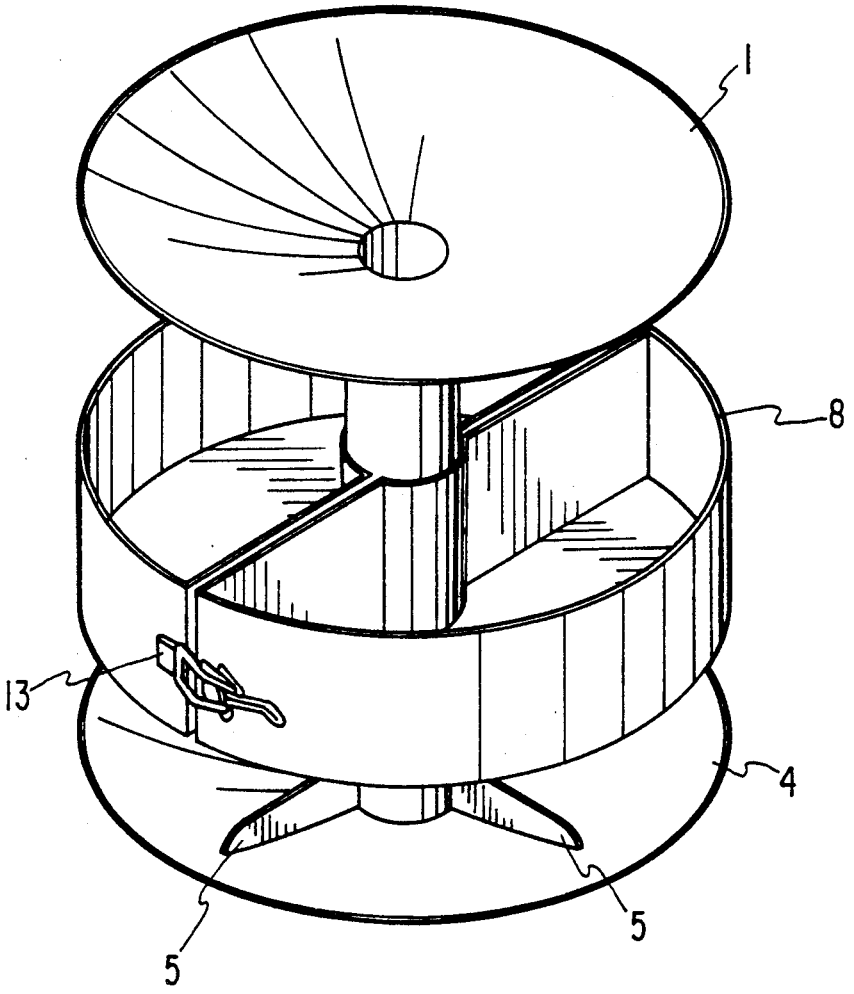
FIG. 7 is a perspective view of the second embodiment of the invention including the tool holder.

FIG. 7 shows the tool holder mounted on the second embodiment of the present invention. A mechanical fastener 13 is provided together with the two halves of the holder. In this figure, the tool holder has vertical walls through the center of the tool holder. Additional vertical walls could be added to separate the tool holder into compartments if desired. The tool holder is shown as having the same diameter as the seat and base. However this may be made smaller if desired as shown in FIG. 1. A larger diameter would also be possible although this may interfere with the user's legs.

The preferred seat is saucer-shaped so that the pillow may be received therein. However, a flat seat or other forms of seats may also be used. Since the base is also concave shaped, it would be possible to store tools in the base as well as in the tool holder. The bracing for both the column and the seat, 3 and 5, may take any shape that is structurally stable.

The seat and base preferably each have a diameter of 18 inches and a curved surface with a 22½ inche radius. The seat should be about 20 inches from the surface on which the stool rests. The column can be a 3 inch diameter hollow cylinder or any shape and size which is strong enough to support the weight of the user.

Figure 5:
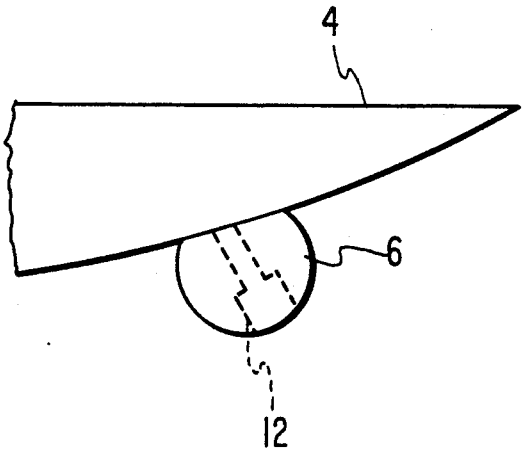
FIG. 5 is a detailed view of part of FIG. 1.

The spheres are preferably 1¼0 inch in diameter and fastened to the outer surface of the base at roughly 2⅝ inches from the rim of the base. The spheres may be mounted by drilling a hole through a diameter and connecting this sphere to the base by a nut and bolt arrangement or any other similar type of fastening means. FIG. 5 shows an enlarged view of the mounting of the spheres to the base. A channel 12 may be drilled in the sphere to receive a bolt for holding the sphere in place.

In use, the stool is easily carried to the garden by the user. The tools may be carried in the tool holder and optionally within the base. The seat may contain a pillow for the comfort of the user. In the garden the user may sit on the stool and rock in all directions in order to reach various locations. In the soft sand or soil of the garden, the spheres allow the stool to be rocked without difficulty. However, if the stool is placed on a hard surface for other uses, or for storage, the spheres prevent the stool from rocking and provide a stable seat. Thus the user cannot only use the stool in his garden but may use it as a conventional stool in the garage, patio or house.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A stool comprising:

a seat;

a vertical supporting member on which said seat rests;

a bowl like base on which said vertical supporting member rest, said base having a concave upper surface and a spheroidal convex lower surface to allow the stool to rock in all direction on a soft surface;

means for preventing rocking on a flat hard surface but allowing rocking on a flat soft surface including a plurality of elements fixedly secured to and protruding from said lower surface.

2. The stool according to claim 1, wherein said elements are spheres.

3. The stool according to claim 1, further comprising bracing for supporting said seat on said vertical supporting member.

4. The stool according to claim further comprising bracing for supporting said vertical supporting member on said base.

5. The stool according to claim 1, further comprising a tool holder mounted on said vertical supporting member for receiving tools.

6. The stool according to claim 5, wherein said vertical supporting member includes a series of holes for supporting said tool holder.

7. The stool according to claim 6, wherein said tool holder is disk shaped and hinged along a diameter.

8. The stool according to claim 1, wherein said seat is saucer-shaped for receiving a pillow.

9. The stool according to claim 1, wherein said seat, said base and said vertical supporting member are made of plastic.

10. The stool according to claim 1, wherein said seat and said base have a protrusion which is received within the vertical supporting member.

11. A stool which is rockable on soft surfaces, comprising:

a seat;

a vertical supporting member on which said seat rests;

a bowl like base on which said vertical supporting member rests, said base having an upper and lower surface, said upper surface being concave and said lower surface being spheroidal convex;

first bracing means for supporting said seat on said vertical supporting member;

second bracing means for supporting said vertical supporting member on said base; and means for preventing rocking on a flat hard surface on which said base rests, including a plurality of spherical elements fixedly secured to and protruding from said lower surface of said base.

12. A stool which is rockable on soft surfaces, comprising:

a seat;

a hollow vertical supporting member on which said seat rests;

a bowl like base on which said hollow vertical supporting member rests, said base having an upper and a lower surface, said upper surface being concave and said lower surface being spheroidal convex;

first protrusion attached to the bottom of said seat and having an external shape approximately an internal shape of said hollow vertical supporting member;

second protrusion mounted on the top of said base and having an external shaped approximating the internal of said vertical supporting member;

wherein said first and second protrusion are received in opposite ends of said hollow vertical supporting member;

means for preventing rocking on a flat hard surface on which said base rests, including a plurality of spherical elements fixedly secured to and protruding from said lower surface of said base.

* * * * *

UNITED STATES PATENT AND TRADEMARK OFFICE

CERTIFICATE OF CORRECTION

PATENT NO. : 5,112,103

DATED : May 12, 1992

INVENTOR(S) : STEPHEN H. DOWNER

It is certified that error appears in the above-identified patent and that said Letters Patent is hereby corrected as shown below:

In column 3, line 39, change "inche" to --inch--;
line 44, change "1¼0" to --1¼--.
In column 4, line 12, change "rest," to --rests--;
line 14, change "direction" to --directions--.

Signed and Sealed this
Tenth Day of August, 1993

*Attest:*

*Attesting Officer*

Michael K. Kirk

MICHAEL K. KIRK

*Acting Commissioner of Patents and Trademarks*